US008833574B2

(12) United States Patent
Sparrow

(10) Patent No.: US 8,833,574 B2
(45) Date of Patent: Sep. 16, 2014

(54) GANTRY WITH SUSPENDING LINKS

(75) Inventor: Stephen Edward Sparrow, Houston, TX (US)

(73) Assignee: Stephen Edward Sparrow, Spring, TX (US)

( * ) Notice: Subject to any disclaimer, the term of this patent is extended or adjusted under 35 U.S.C. 154(b) by 147 days.

(21) Appl. No.: 13/226,722

(22) Filed: Sep. 7, 2011

(65) Prior Publication Data

US 2012/0055898 A1 Mar. 8, 2012

Related U.S. Application Data

(60) Provisional application No. 61/380,844, filed on Sep. 8, 2010.

(51) Int. Cl.
*B66C 5/02* (2006.01)
*B66C 17/04* (2006.01)

(52) U.S. Cl.
CPC ..... *B66C 17/04* (2013.01)
USPC ..... 212/324; 212/314; 212/343

(58) Field of Classification Search
USPC ..... 212/96, 97, 98, 314, 315, 316, 319, 212/324, 325, 326, 327, 271, 199, 203, 341, 212/348, 349; 414/460, 591
See application file for complete search history.

(56) References Cited

U.S. PATENT DOCUMENTS

| | | | | | |
|---|---|---|---|---|---|
| 3,281,121 | A | * | 10/1966 | Ratcliff | 254/372 |
| 3,519,246 | A | * | 7/1970 | Belding | 254/264 |
| 4,059,194 | A | | 11/1977 | Barry | |
| 4,168,009 | A | * | 9/1979 | Ide | 414/142.1 |
| 4,381,839 | A | * | 5/1983 | Engler et al. | 212/314 |
| 4,433,952 | A | * | 2/1984 | Glickman | 414/460 |
| 4,718,563 | A | | 1/1988 | Ellgass | |
| 5,653,351 | A | * | 8/1997 | Grout et al. | 212/315 |
| 5,865,327 | A | * | 2/1999 | Johnston | 212/343 |
| 5,909,869 | A | * | 6/1999 | Sandøy et al. | 254/264 |
| 6,543,605 | B2 | | 4/2003 | Fiatel | |
| 7,073,673 | B2 | | 7/2006 | Takehara | |
| 2008/0159831 | A1 | * | 7/2008 | Davis | 414/140.3 |

FOREIGN PATENT DOCUMENTS

| | | | | | |
|---|---|---|---|---|---|
| JP | 10140839 | A | * | 5/1998 | E04G 21/16 |
| SU | 631438 | A | * | 11/1978 | B66F 7/02 |

* cited by examiner

*Primary Examiner* — Emmanuel M Marcelo
*Assistant Examiner* — Justin Stefanon
(74) *Attorney, Agent, or Firm* — Streets & Steele; Patrick K. Steele; Jeffrey L. Streets

(57) ABSTRACT

The gantry system (10) includes jack legs (12) and header beams (14). The load may be supported on a metal chain (20) comprising of a plurality of metal links (24). Each link has a stop surface (28) for engaging a support plate (30) laterally movable with respect to support structure (18).

16 Claims, 5 Drawing Sheets

GANTRY WITH SUSPENDING LINKS

CROSS-REFERENCE TO RELATED APPLICATION

This application claims the priority of U.S. Provisional Application No. 61/380,844 filed on Sep. 8, 2010 the disclosure of which is incorporated herein by reference for all purposes.

FIELD OF THE INVENTION

The present invention relates to gantries of the type commonly used for moving a heavy load. More particularly, the invention relates to a gantry with a plurality of links for lifting a load, with the links capable of suspending a load independent of the hydraulic jack legs.

BACKGROUND OF THE INVENTION

A hydraulic gantry is a well-known lifting and moving device having two or more hydraulic jack legs, one or more header beams, and devices for rigging. The hydraulic jack legs are capable of lifting very large loads, e.g., for construction, storage or transportation purposes. Hydraulic jack leg units use hydraulic cylinders, and loads are conventionally rigged to and hang from the header beam. Once the load is lifted, the load may be transported with hydraulic propel jacks or hydraulic propel wheels.

A hydraulic gantry system frequently has problems where the load must be lifted above an obstruction before it can be transported, but there is limited head room for lifting. A gantry conventionally requires a large amount of head room above the header beam for accommodating the strand jacks and strand guides above the header beam. With conventional gantries, an overhead obstruction often means days of disassembling the apparatus to pass under a load beam. Other extensive and time consuming steps may be taken to support the headroom problem for a conventional gantry system, although the conventional solution continues to involve disassembly of the load and/or special rigging.

One prior art system uses a specially made support frame to support the load, lifting bars to lift the support frame and the load, and separate suspension bars to suspend the load from the header. This design has three components to handle the load, namely a special support frame, a lifting bar, and a suspension bar. This system is both expensive to manufacture and maintain, and time consuming to use.

A gantry system with adjustable side supports is disclosed in U.S. Pat. No. 4,381,839. U.S. Pat. No. 4,718,563 discloses an overhead gantry spanning a roadway. A gantry with a harmonic lift drive is disclosed in U.S. Pat. Nos. 6,543,605, and 7,073,673 discloses a wire rope reeving support system for a gantry. U.S. Pat. No. 4,057,194 discloses a container overhead transfer and storage system.

The disadvantages of the prior art are overcome by the present invention, an improved gantry lift system is hereinafter disclosed.

SUMMARY OF THE INVENTION

In one embodiment, a hydraulic gantry is provided for lifting and moving a load, including a plurality of hydraulic jack legs and one or more header beams supported at the upper end of the hydraulic jack legs. A plurality of vertical links forming a chain suspended from one of the header beams, with each link pivotally connected to another of the plurality of links and including at least two planar stop surfaces thereon. A support plate below the header beam is moved laterally from a disengaged position to an engaged positioned such that the plurality of stand jacks may lower a link to engage a support surface and thereby suspend the load from the support plate. Rigging may be used to connect the load to the chain, such that the load may be supported on the support plate when fluid pressure is reduced to the plurality of the hydraulic jack legs. One or more links may then be removed from the chain, and the shortened chain desirably reduces the vertical spacing between the header and the load.

These and further features and advantages of the present invention will become apparent from the following detailed description, wherein reference is made to the figures in the accompanying drawings.

DETAILED DESCRIPTION OF PREFERRED EMBODIMENTS

Figure 1:
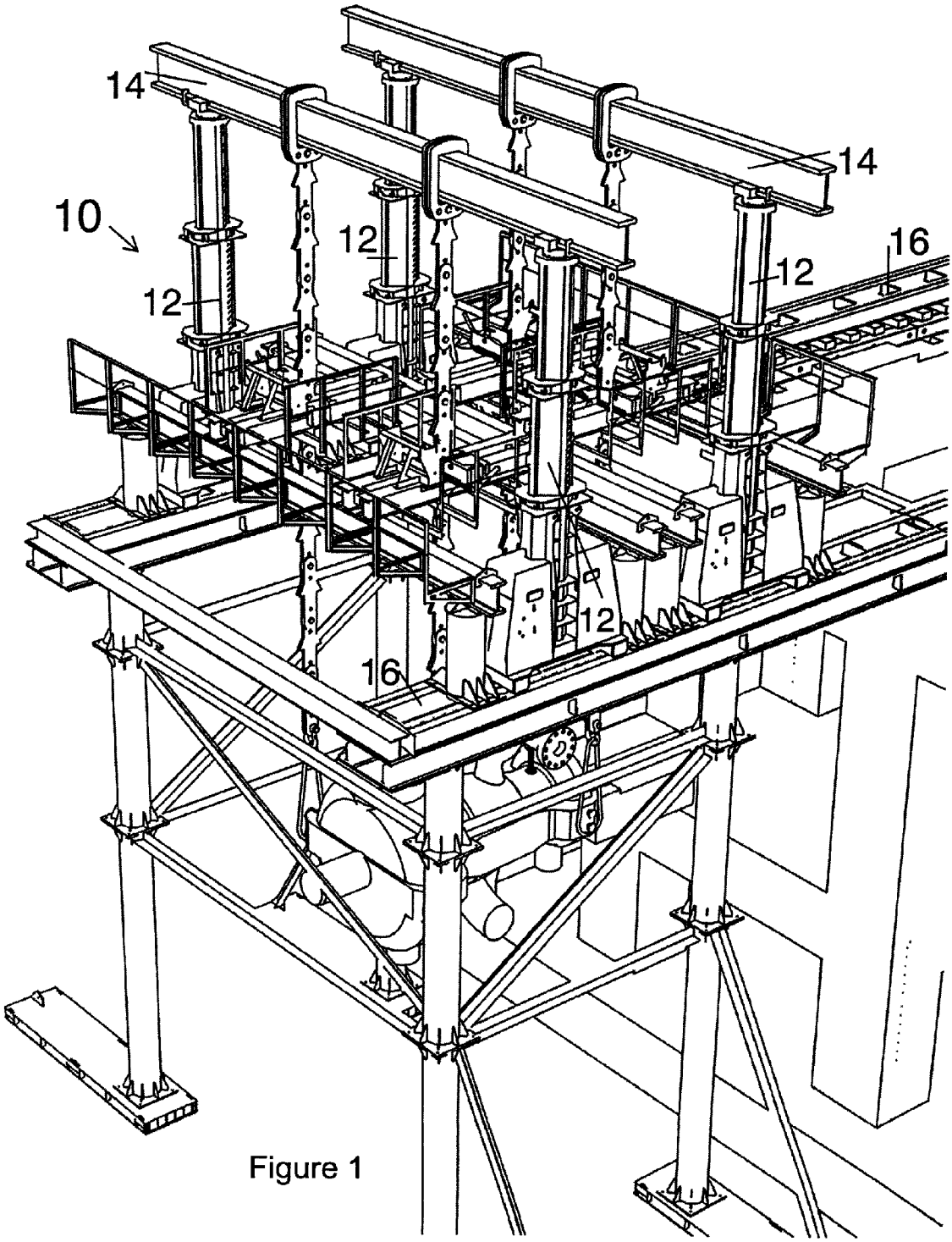
FIG. 1 illustrates one embodiment of a gantry according to the present invention.

The gantry system 10 as shown in FIG. 1 includes four hydraulic jack legs 12 and two header beams 14, with each header beam being supported at the upper end of two associate hydraulic jack legs. The gantry system further includes a runway track 16 for moving the header beams and a load, which in FIG. 1 is depicted by load L. Support structure 18 is provided for supporting a base of each strand jack above the load L. Other systems may include six or more hydraulic jack legs and/or three or more header beams.

Figure 2:
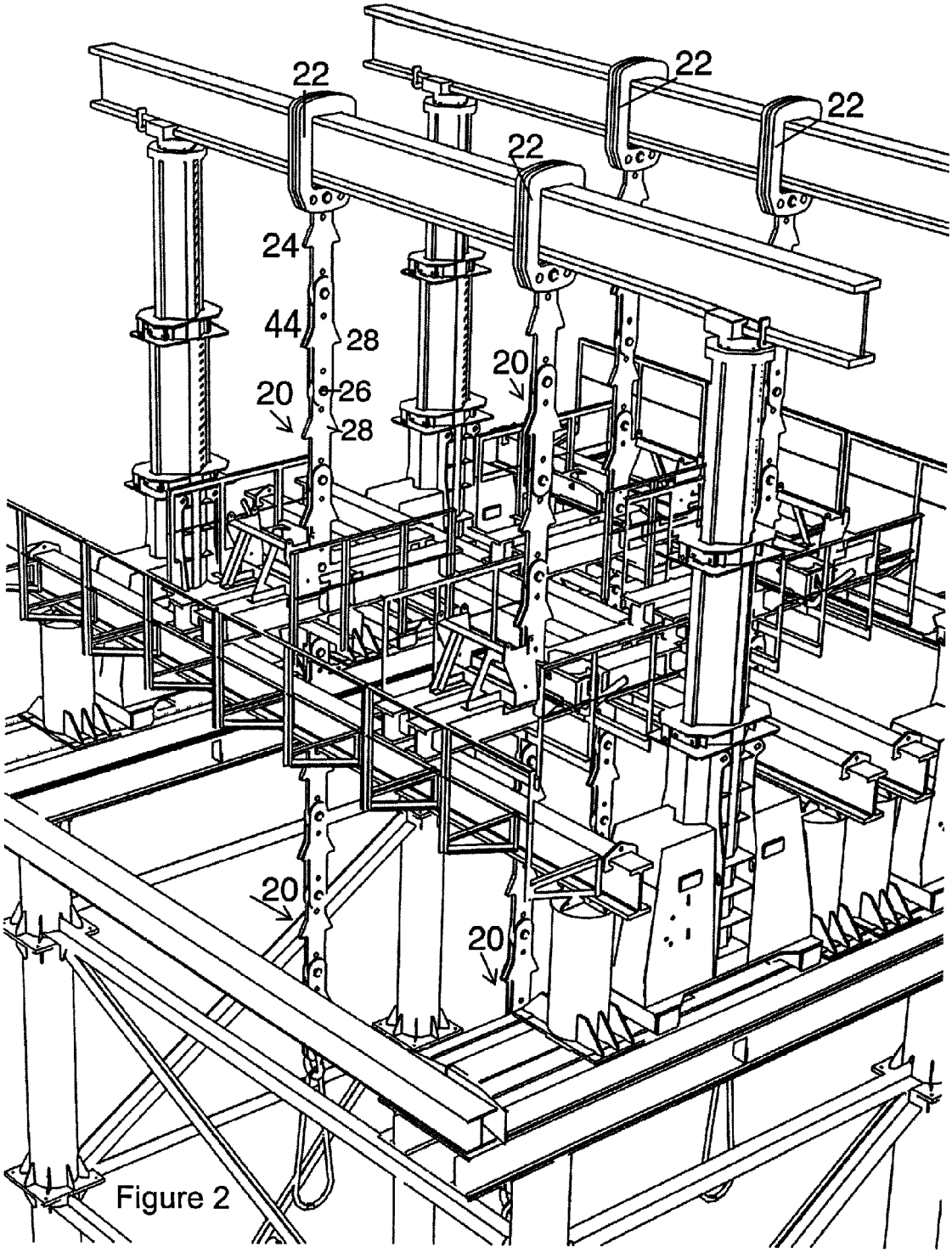
FIG. 2 illustrates in further detail the lifting and suspension links.

FIGS. 1 and 2 depict a portion of the gantry shown in FIG. 1, including the hydraulic jack legs 12, the header beam 14 and the track 16. FIG. 2 also more clearly depicts a beam clamp 22 for supporting a metal chain 20, which in this case comprises a plurality of metal links 24. The chain 20 comprising metal links thus hangs from the beam clamp 22 and thus from a header beam 14.

Figure 3:
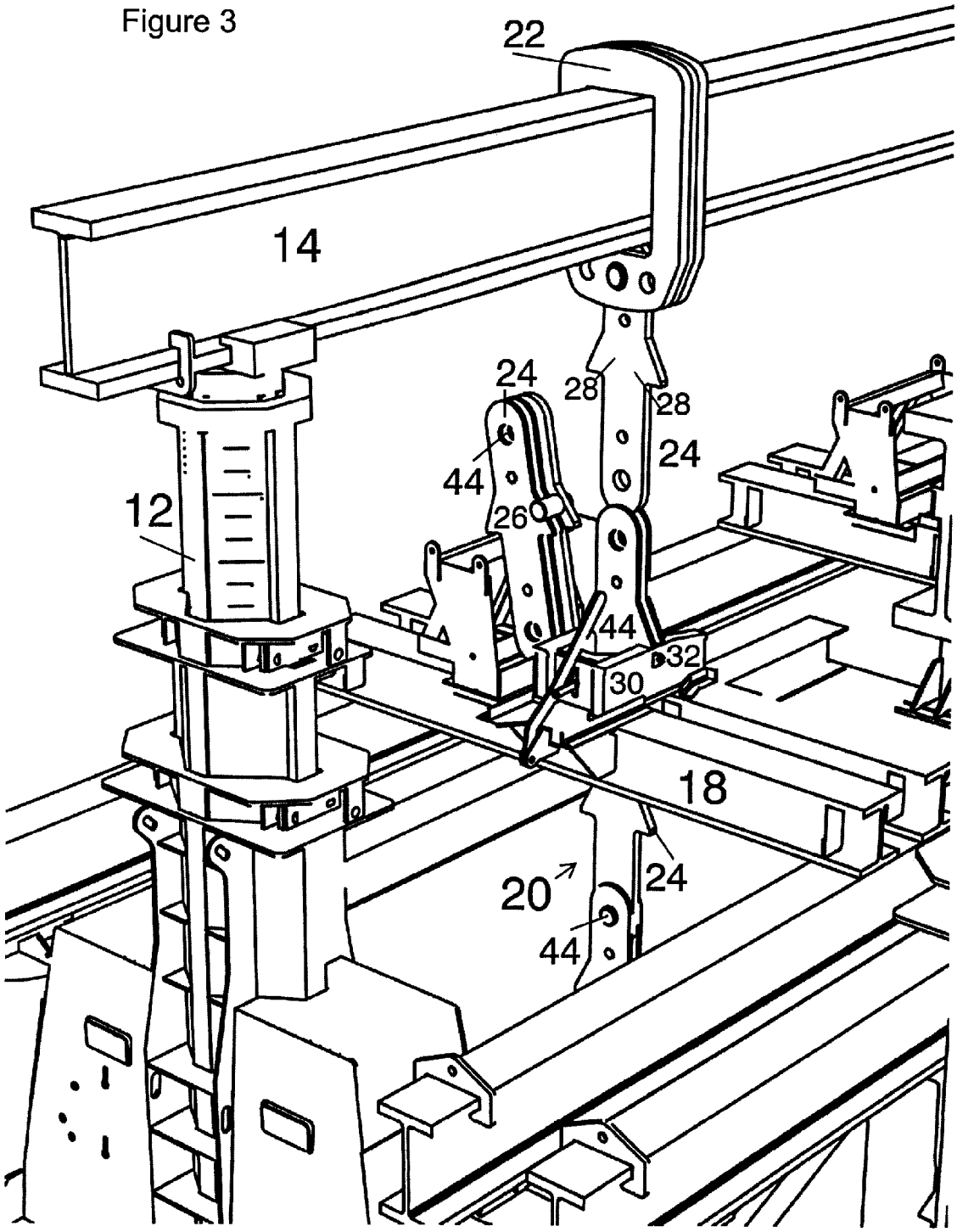
FIG. 3 illustrates in greater detail the lifting links and suspension links.

FIG. 3 more clearly depicts that the metal chain 20 comprises a series of two parallel links 44, followed by a single metal link 24, followed by a pair of parallel links, etc. The spacing between the pair of metal links is conveniently the thickness of the single link. Each link has an upper aperture for receiving a pin 26, and a lower aperture for receiving a similar pin 26, such that a single link points with respect to the pair of links, and the pair of links together pivot with respect to the single link. Each link also has a stop surface 28, and in this case has a pair of stop surfaces 28 on opposing sides of each metal link. Each stop surface 28 is a planar surface intended for substantially planar engagement with support plate 30, which is laterally movable with respect to support structure 18. Support plate 30 may be movable from a disengaged position wherein the links freely pass by the support plate, to an engaged position as shown in FIG. 3 when the link and the load is supported form the plate 30. The planar surfaces 28 engage the planar support surfaces 32 on the support plate, so that the load is supported by the support plate and the links below the support plate. Accordingly, upper links may then be removed from the chain so that the header beam is lowered with respect to the load.

Once the load has been lifted to the necessary height, the support structure may be connected to the two header beams via a lifting sling or chain 34. On the next extension of the hydraulic jack legs, the supporting structure and the load are raised together to clear of the gantry tracks and the entire system is then free to travel along the gantry tracks to the desired position. The previously described lifting process is then reversed to lower and place the load.

Figure 6:
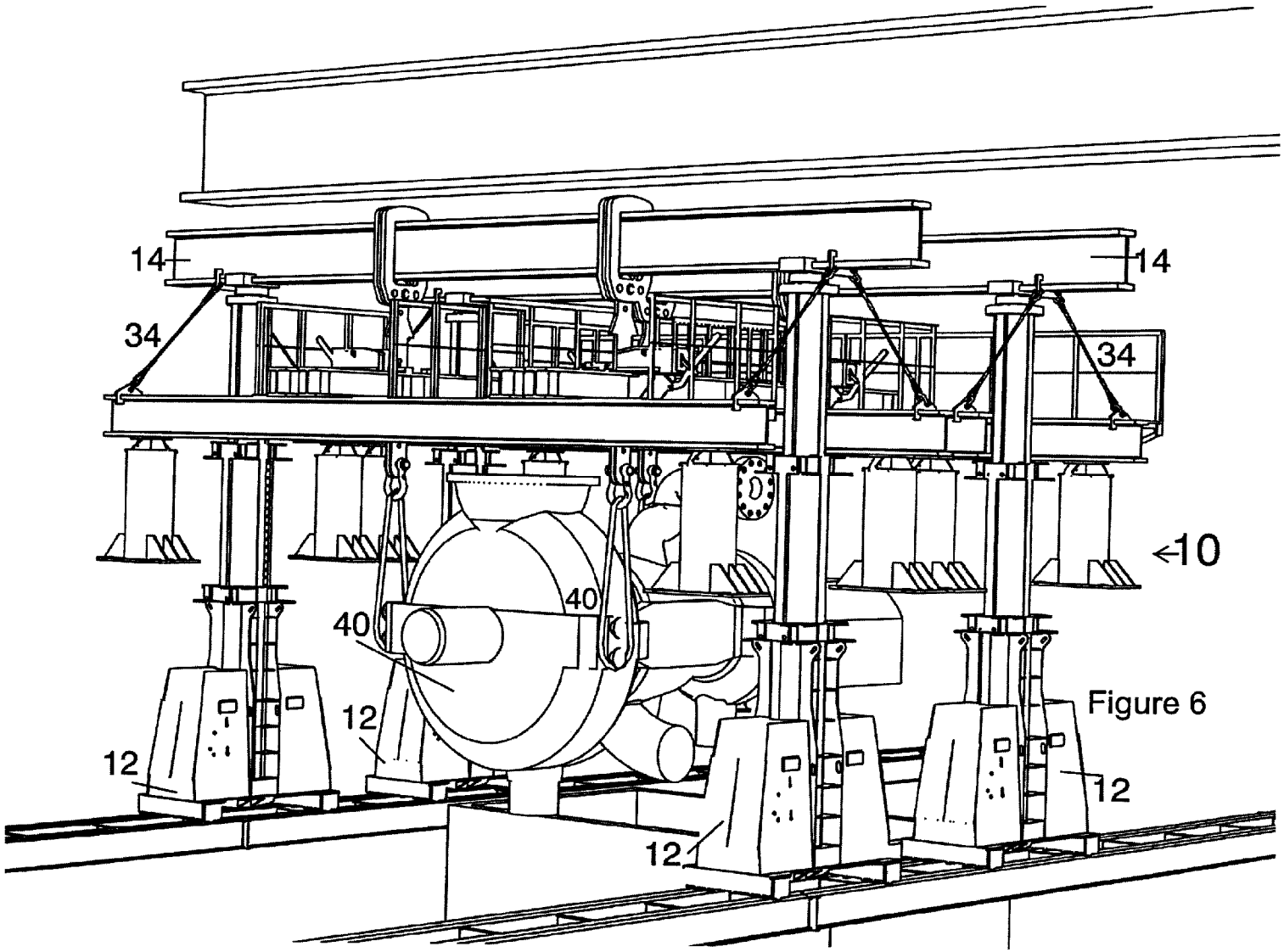
FIG. 6 illustrates the gantry system with links removed to lower the header beam.

FIG. 6 conceptually depicts a portion of the gantry 10 shown in FIG. 1 with less clearance load, i.e., links have been removed from the chains to lower the header beam 14 with respect to the load until the chain consists of a single link (or 3 links) with standard rigging 40 supporting the load and connected to the lower end of the links. A load positioned as shown in FIG. 1 may thus be raised with respect to the header beam 14 to a position as shown in FIG. 6.

The gantry system of the present invention is fully capable of operation with relatively low headroom. Depending on the application, the spacing between connecting pins at the upper and lower end of a link may be approximately 3½ feet, but as disclosed above a preferred system utilizes two-spaced links followed by a single center link, followed by two-spaced link, etc. Accordingly, both a pair of links and a single links are commonly removed during restroking of the jack legs, so that the system will require less than ten feet of overhead clearance for reliable operation.

Figure 5:
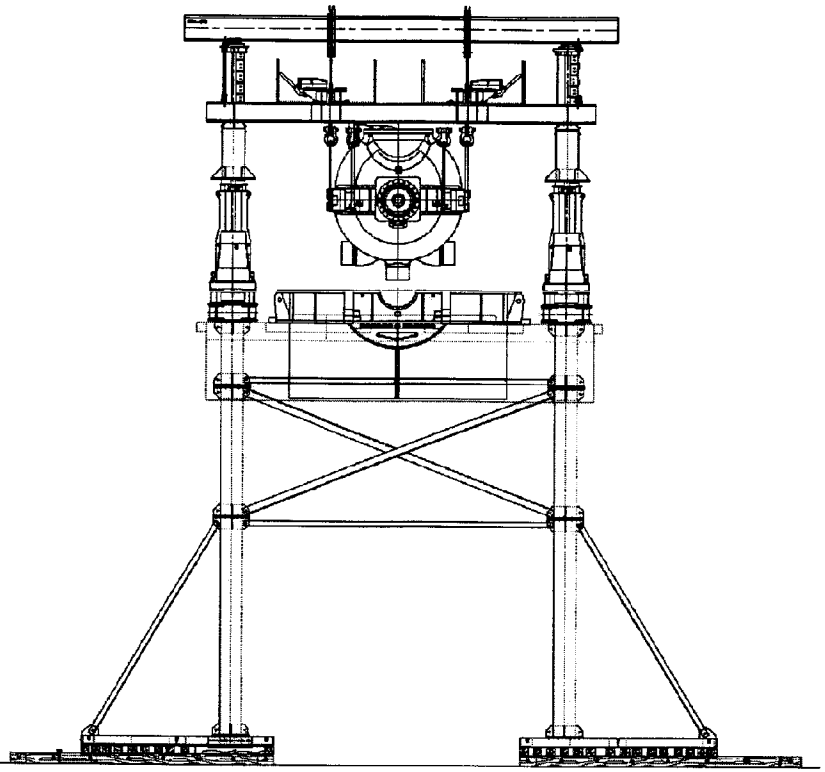
FIG. 5 illustrates the difference in required operating headroom for the gantry of this invention.
Figure 4:
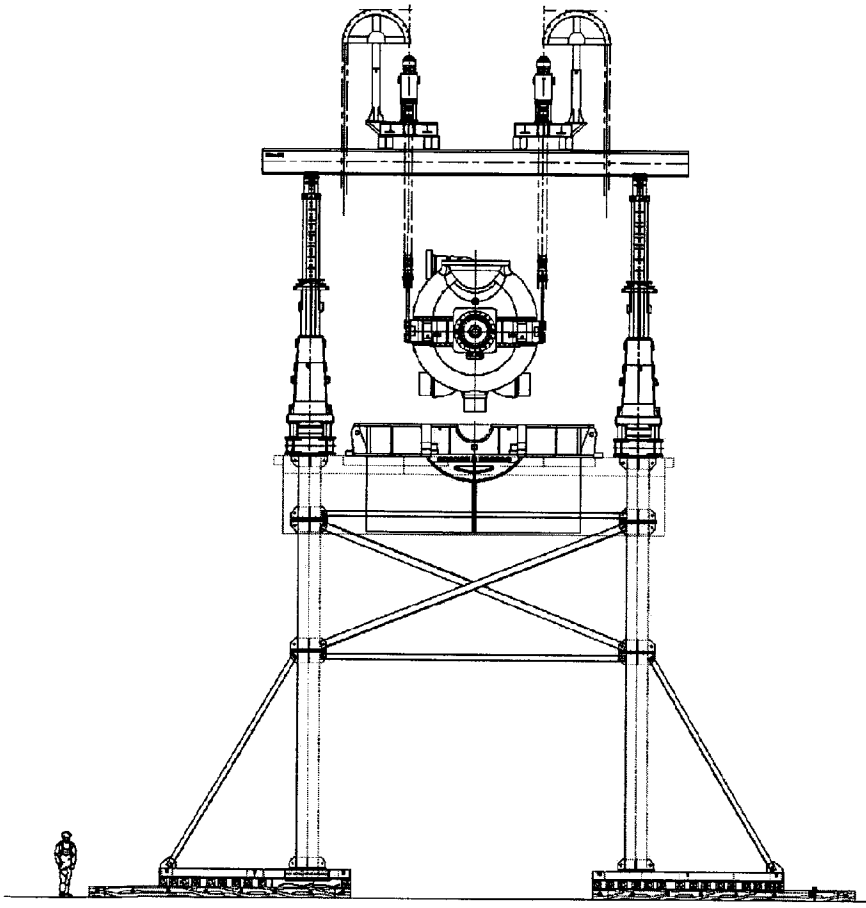
FIG. 4 illustrates a prior art gantry system with a low overhead clearance.

FIG. 4 shows a conventional gantry system, and illustrates the large amount of headroom required for the strand guides above the header beam and the spacing between the header beam and load. FIG. 5 illustrates one embodiment of the gantry system according to the present invention, wherein the headroom has been substantially reduced by the features of this invention.

The hydraulic jack legs themselves need not be modified, so that these complicated and precision assemblies are not adversely affected by the present system. The system also has a comparatively low cost, and fabrication of the links is significantly less than the price of a single strand jack. The absence of electronic and sensitive components ensures that this system is not affected by moisture, dust, or climate, and the system is robust for rough handling. With the system of the present invention, the load is always under positive control by either a jack leg or by engagement of a link with a support plate.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A hydraulic gantry system for lifting and moving a load, comprising:

a plurality of hydraulic jack legs;

one or more header beams movably supported at an upper end of the hydraulic jack legs;

a chain having a beam clamp, a first end link coupled to the beam clamp, a second end link connectable to the load, and a plurality of pivotally coupled vertical links, each vertical link including two opposed, elongated, flat and downwardly disposed stop surfaces, the beam clamp of the chain being connected to one of the one or more header beams; and at least one support plate movably disposed below at least one of the one or more header beams for laterally moving from a disengaged position, wherein upon vertical movement of the chain, the opposed, elongated, flat and downwardly disposed stop surfaces of the plurality of vertical links pass by the support plate as the plurality of hydraulic jack legs are lowered to lower the one or more header beams, to an engaged position to engage the two opposed, elongated, flat and downwardly disposed stop surfaces on an engaged vertical link as the plurality of hydraulic jack legs are lowered to lower the one or more header beams and to thereby support the load on the opposed, elongated, flat and downwardly disposed stop surfaces of the engaged link and from the support plate engaged thereby;

wherein any one of the plurality of the vertical links of the chain with the two opposed, elongated, flat and downwardly disposed stop surfaces may be engaged and supported on the support plate disposed in the engaged position; and wherein hydraulic fluid pressure can be relieved from the plurality of hydraulic jack legs by moving the support plate to the engaged position to engage and support the two opposed, elongated, flat and downwardly disposed stop surfaces on an engaged vertical link of the chain as the hydraulic jack legs and the one or more header beams are lowered to transfer the load from the one or more header beams to the support plate; and wherein one or more of the vertical links of the chain are removable from the chain to provide a shortened chain including fewer vertical links to span a reduced vertical spacing between the one or more header beams and the load.

2. The hydraulic gantry system as defined in claim 1, wherein at least one vertical link of the chain comprises a first plate and a second plate in a spaced apart and substantially parallel configuration to form a gap therebetween, and an adjacent link comprises a third plate aligned with the gap between the first plate and the second plate and pivotally connected to a proximal end of the link comprising the first and second plates.

3. The hydraulic gantry system as defined in claim 1, wherein the support plate is laterally movable from the disengaged position to the engaged position.

4. The hydraulic gantry system as defined in claim 1, further comprising:

a runway track for moving the one or more header beams laterally.

5. The hydraulic gantry system as defined in claim 1, further comprising:

a beam clamp for interconnecting the first end link of the chain and a header beam.

6. The hydraulic gantry system as defined in claim 1, wherein each vertical link of the chain comprises a metal alloy.

7. The hydraulic gantry system as defined in claim 1, wherein the plurality of hydraulic jack legs comprises four hydraulic jack legs.

8. The hydraulic gantry system as defined in claim 7, wherein the one or more header beams comprises two header beams.

9. A hydraulic gantry system for lifting and moving a load, comprising:

four or more hydraulic jack legs;

two or more header beams, each header beam supported at an upper end of a pair of the four or more hydraulic jack legs;

a chain including a plurality of interconnected vertical links, each vertical link having two opposed, elongated, downwardly disposed and flat stop surfaces thereon, and forming a chain suspended from a first end link connected to one or more of the header beams; and a support plate having a flat stop surface thereon, the support plate disposed below a header beam and movable between a disengaged position, wherein the vertical links of the chain pass by the support plate, to an engaged position, wherein the two opposed, elongated, downwardly disposed and flat stop surfaces of an engaged vertical link engages the flat stop surface of the support plate;

wherein the plurality of hydraulic jack legs are movable to lower the engaged vertical link to engage the two opposed, elongated, downwardly disposed and flat stop surfaces on the engaged vertical link with the flat stop surface of the support plate in the engaged position to thereby support the load and the chain from the support plate; and wherein any selected vertical link with two opposed, elongated and flat stop surfaces thereon may be engaged with and supported on the support plate in the engaged position to relieve fluid pressure from the plurality of hydraulic jack legs as the hydraulic jack legs are lowered.

10. The hydraulic gantry system as defined in claim 9, wherein at least one vertical link of the chain comprises a first plate and a second plate spaced apart and substantially parallel to form a vertical link having a gap between the first and second plates, and an adjacent vertical link comprising a third plate that is pivotally connected to the at least one vertical link comprising the first and second plates and aligned with the gap.

11. The hydraulic gantry system as defined in claim 9, further comprising:

a runway track for moving the one or more header beams laterally.

12. A hydraulic gantry system for lifting and moving a load, comprising:

a plurality of hydraulic jack legs;

one or more header beams supported at an upper end of the hydraulic jack legs;

a chain including a plurality of vertical links, each vertical link having two opposed, elongated and flat stop surfaces thereon, the chain being suspended from a first end link connected to one or more of the header beams and connectable to the load, at least one of the vertical links having two spaced-apart and substantially parallel plates forming a gap therebetween, and at least one adjacent vertical link comprising a third plate that is aligned with the gap and pivotally connected to the at least one vertical link with the two spaced-apart plates; and a support plate having a stop surface and disposed below a header beam, the support plate movable between a disengaged position, wherein the vertical links pass by the stop surface of the support plate, to an engaged position wherein the plurality of hydraulic jack legs can be moved to lower the two opposed, elongated and flat stop surfaces of a engaged vertical link to engage the stop surface of the support plate and to thereby support the load and the chain from the support plate.

13. The hydraulic gantry system as defined in claim 12, further comprising:

a runway track for moving the one or more header beams laterally.

14. The hydraulic gantry system as defined in claim 12, further comprising:

a beam clamp for interconnecting the first end link of the chain and one of the one or more header beams.

15. The hydraulic gantry system as defined in claim 12, wherein the plurality of hydraulic jack legs includes four or more hydraulic jack legs.

16. The hydraulic gantry system as defined in claim 12, wherein at least one of the vertical links of the chain is removable from the chain to provide a shortened chain that spans the reduced vertical spacing between the header beam and the load.

* * * * *